US009936319B2

(12) United States Patent
Kauppila et al.

(10) Patent No.: US 9,936,319 B2
(45) Date of Patent: Apr. 3, 2018

(54) MICROPHONE DEVICE, METHOD TO OPERATE AND A SYSTEM THEREOF

(71) Applicant: TRICK TECHNOLOGIES OY, Espoo (FI)

(72) Inventors: Timo Kauppila, Espoo (FI); Lasse Korpela, Espoo (FI); Mikelis Studers, Helsinki (FI); Pyry Taanila, Espoo (FI)

(73) Assignee: TRICK TECHNOLOGIES OY, Espoo (FI)

( * ) Notice: Subject to any disclaimer, the term of this patent is extended or adjusted under 35 U.S.C. 154(b) by 28 days.

(21) Appl. No.: 14/435,611

(22) PCT Filed: Oct. 14, 2013

(86) PCT No.: PCT/FI2013/050985

§ 371 (c)(1),
(2) Date: Apr. 14, 2015

(87) PCT Pub. No.: WO2014/060647

PCT Pub. Date: Apr. 24, 2014

(65) Prior Publication Data

US 2015/0289074 A1 Oct. 8, 2015

(30) Foreign Application Priority Data

Oct. 15, 2012 (FI) ..... 20126070

(51) Int. Cl.
*H04R 3/00* (2006.01)
*H04R 29/00* (2006.01)
*H04R 1/40* (2006.01)

(52) U.S. Cl.
CPC ..... *H04R 29/004* (2013.01); *H04R 1/406* (2013.01); *H04R 2410/00* (2013.01)

(58) Field of Classification Search
CPC ..... H04R 2499/11; H04R 3/007; H04R 19/04
USPC ..... 381/122, 162, 372, 94.5, 94.8
See application file for complete search history.

(56) References Cited

U.S. PATENT DOCUMENTS

| | | | | |
|---|---|---|---|---|
| 8,989,420 | B1 * | 3/2015 | Hamer | H04R 1/02 381/122 |
| 2006/0233406 | A1 | 10/2006 | Fischer | |
| 2007/0038409 | A1 * | 2/2007 | Gilson | G01C 21/16 702/150 |
| 2009/0305785 | A1 | 12/2009 | Beeman et al. | |
| 2010/0248832 | A1 | 9/2010 | Esaki et al. | |
| 2011/0068944 | A1 | 3/2011 | Sacknoff | |
| 2012/0070018 | A1 * | 3/2012 | Grattan | H04R 3/007 381/122 |
| 2013/0260827 | A1 * | 10/2013 | Shuster | H04M 1/026 455/556.1 |

OTHER PUBLICATIONS

International Search Report, dated Jan. 27, 2014, from corresponding PCT application.

* cited by examiner

*Primary Examiner* — Alexander Jamal
(74) *Attorney, Agent, or Firm* — Young & Thompson

(57) ABSTRACT

A microphone device that can be thrown to a member of an audience or to another user so that the microphone device recognizes the state of the motion of the microphone device and switches from a first state of motion to another state of motion when the state of motion is changed during the throw and switches the state of the microphone device from a mute state to unmute state according to the state of the motion.

14 Claims, 3 Drawing Sheets

MICROPHONE DEVICE, METHOD TO OPERATE AND A SYSTEM THEREOF

The invention belongs in a very general level to the field of wireless communication of audible signals, but more specifically to the field of using a microphone in a microphone device, as an independent claim thereof specifies in the preamble part of the independent claim directed to the microphone device.

BACKGROUND

Communication in a conference has its challenges in a large room or presentation space to the organizing parties. Not only in the form of audio-visual techniques as such for one sided lecturing, but as in many cases the audience is welcomed to participate in the discussion, i.e. to communicate two ways between the audience and the presenter.

One problem relates to the microphones, which have been turned to wireless as such in order to make the counter questioning easier for the audience members. However, in a crowded space, the audience members that are intending to ask something or willing to comment on the speech, are ajar situated in the scene. Thus, microphone that is necessary or at least convenient in the vast rooms, to get the voice of audience members to get heard over the noise originating from the people present in the room has to be passed from person to person from the respective hand from a person to the next person sitting just next to the first person. This is slow, especially when there are many members in the audience situated far away from each other in a random manner. Precious time is wasted, as well as in the cases, where a microphone runner is hired to serve the microphone from an audience member to another.

In many cases, also the nature of such events becomes very formal, and a bar for asking a question or presenting a comment is unnecessarily raised. Also hitting the microphone and/or dropping a microphone may not only cause funny noises and may be annoying for the audience as well as to the speaker in question, but also severely damage audio system devices in the worst case.

Embodiments of the invention solve, or at least mitigate these problems. This is made by the microphone device according to an embodiment of the invention.

A microphone device according to the invention is characterized in that what has been said in an independent claim thereof in the characterizing part.

A method of operating a microphone device according to the invention is characterized in that what has been said in an independent claim thereof in the characterizing part.

A microphone system according to the invention is characterized in that what has been said in an independent claim thereof in the characterizing part.

Other embodiments are indicated in dependent claims, examples and figures provided with exemplifying examples on embodiments.

Embodiments are combinable in suitable part.

A microphone device according to an embodiment comprises at least a casing, microphone unit, communicator unit and a controller unit in it functionally comprising a memory and a microprocessor characterized in that the microphone device comprises further a sensor unit for sensing the state of the motion of the microphone device for providing a control signal responsive to the state of the motion of the microphone device so that in the control of said sensor unit either at least one of the microphone unit or the communicator unit is/are set from a first state of communication corresponding a first state of the control signal to a second state of communication corresponding a second state of control signal, so that when the control signal has a quantity value in a pre-determined range to represent the state of the motion as a threshold value for defining the state of the motion whether or not the control signal value belongs to the range of the first control signal level that is corresponding the first state of motion or to the range of the second control signal level that is corresponding the second state of motion.

In this ensemble of embodiments the microprocessor defines, according to at least one sensor, the state of the motion of the microphone device. Although a skilled person in the art knows many ways to make a control signal use to control a device as such, for example a threshold range dependency for a control signal as such, it is not the aim of the embodiments to claim the mere threshold range dependency for operation of the device via a control signal formation according to the known techniques as such alone.

In this embodiment the microphone device can be a throwable unit comprising a microphone or a microphone unit. Microphone unit may comprise in an embodiment a microphone, but also further electronics as such for controlling the operation of the mere microphone component, to switch on/off and/or filtering.

According to an embodiment the microphone unit is configurable so that said first state of communication is the state of silence. In the state of silence the microphone unit is muted for the external devices in the microphone system. The muting can be made by muting at least one of the microphone unit and communicator unit.

According to an embodiment the microphone device is configurable so that said second state of communication is state of active, state of voice. In the state of active the microphone device is active for the external devices in the microphone system. The activating can be made by making at least one of the microphone unit and communicator unit active.

In the embodiments expressions first and second are only used as temporal names to differentiate their main expressions from each other, so aiming only to simplify the language, without any intention to restrict the order, quality or quantity in the expression comprising first and/or second as an attribute.

In an embodiment the first state or the second state can be such a state in which there is an attenuated signal present to be further delivered to a system device or its part.

According to an embodiment of the invention the microphone device can comprise such a communicator unit that comprises a transmitter-receiver unit for a duplex communication with an external unit.

Duplex in this context is used to refer to two-way communication. In this embodiment variant, the microphone device, or its part or parts via the controller unit can be controlled by the signals sent from an external microphone system device. Such a system device can comprise a blue tooth, WLAN, or other radio-communication means to send signals to the microphone device, which in such an embodiment comprises the corresponding means to receive the signals to be utilized as data and/or parameters in the operation of the microphone device. This way muting can be controlled, i.e. which parts to be kept in a muted state and which are kept active. This way also the communicator can be kept in an active state, but ignored to receive the signal that would be available.

According to an embodiment variant a separate microprocessor unit without the sensors for detecting motion could be in the external unit that receives the signal and that external unit makes the decision what should be done with the signal, i.e. muted, faded, etc., so the work is done in the receiver side and not the throwable microphone side.

According to an embodiment the microphone device according to an embodiment comprises such a controller unit that comprises a coder programmed to code the signal from a microphone device as a microphone signal into digital form electric signal. The coder can be in suitable part built from software pieces to code the signals into electrical form. This way the signal can be made secret, hidden or pseudo randomized so that even if there were several microphone devices in use in the same room, their signals could be separable via the coding without unintentional overlapping.

In an embodiment variant a coder can be used to decode or translate the via-communicator-unit received commands to be executed in the microphone device's processor. Parameters and other information can be decoded so to the use of the microphone device. Also signal processing commands and/or data can be thus communicated to the microphone device from an external source. According to an embodiment the coder can be updated to correspond to a certain radio communication protocol, which can be a known one as such. According to an embodiment of the invention the microphone device comprises such a sensor unit which comprises at least one of the following components: accelerometer, gyroscope, magnetometer, position sensor, acoustic sensor for Doppler measurements, barometric pressure sensor, other pressure sensor, a combination of said components comprising at least one kind of said components equally or more than two. Thus, should it be mentioned that there are in fact in one example of such embodiment two separate transducers in the system, one for sensing and one microphone.

This way, redundant measurements can be made in parallel and/or in series, to better stabilize the operation when the device is being thrown and/or when landing. Also information from acoustics of the room or space can be received so. According to an embodiment of the invention the microphone device comprises an acoustic transmitter for making sound outside the audible human range, for making measurements of the acoustics.

A method for operating a microphone device comprises:

- monitoring the state of the motion of the microphone device,
- changing the state of the motion of the microphone device,
- as a response to the changed state of the motion, generating to a corresponding state of the motion a state of a control signal by the sensor unit,
- setting at least one of the microphone unit or the communicator unit from a first state of communication corresponding a first state of the control signal to a second state of communication corresponding a second state of control signal,
- reversing at least one of the microphone unit or the communicator unit from a first state of communication corresponding a first state of the control signal to a second state of communication corresponding a second state of control signal as a response to a further change in the state of the motion of the microphone device,
- forming from the microphone signal a digital electric signal to be sent to an external station.

According to an embodiment of the invention in the method of operating the microphone device it is set into a third state, a measurement state, in which the microphone device is programmed to make measurements from a signal from at least one microphone of the microphone device.

According to an embodiment of the invention a microphone system comprises an external communication unit to at least one embodied microphone device, said external communication unit being arranged to communicate with said at least one microphone device. The communication can be done wirelessly. The communication can follow an electronic digital protocol that is known as such, in order to communicate radio signals between system elements of the microphone system. System element can be in an embodiment a microphone device as embodied, but also as a system element, an external microphone system unit as system element that is used in communication with the microphone device can be counted as system element in this context. External system element can comprise a mere receiver capable of receiving the signals from a microphone system element, but in another embodiment can also comprise a transmitter to transmit wirelessly radio signals to the microphone device as the system element, following a predetermined communication protocol. The receiver in the microphone system element can also be a receiver as such, or being comprised in an transceiver as such as a module separately operable with the microphone system.

According to an embodiment of the invention the transmitter in the microphone device can be embodied by a body pack transmitter.

Embodiments of the invention are combinable in suitable part. Term comprise is used as an open term.

In the following a reference is made to the figures being attached to the description of the embodiments of the invention. In the following figures examples are indicated about embodiments of the invention, but in a manner that is not intended to restrict the scope of the claims only to the shown embodiments in the figures.

Figure 1:
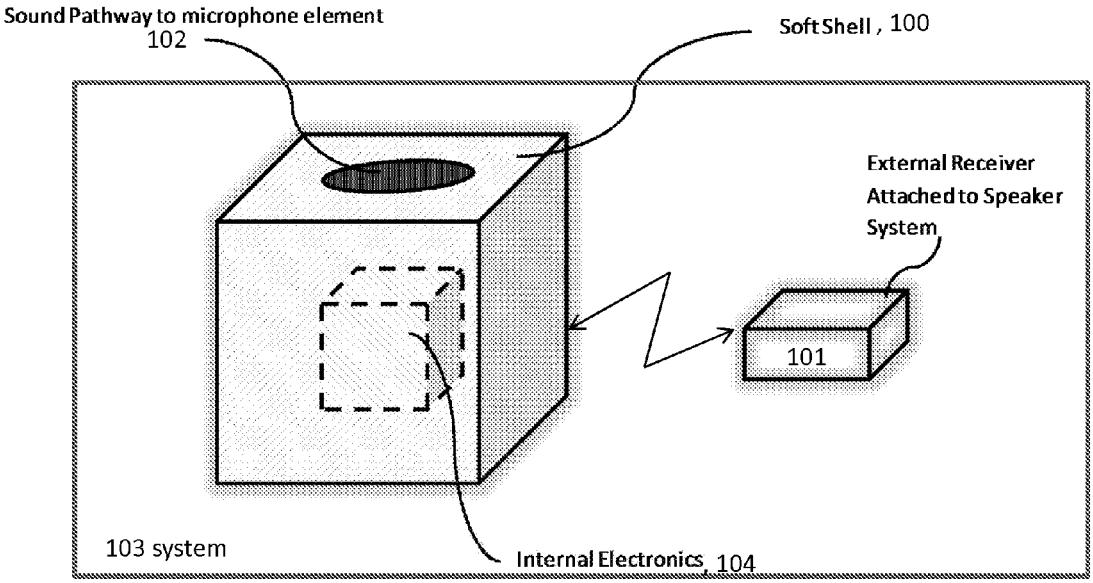
FIG. 1 illustrates embodiments of the invention.
Figure 1:
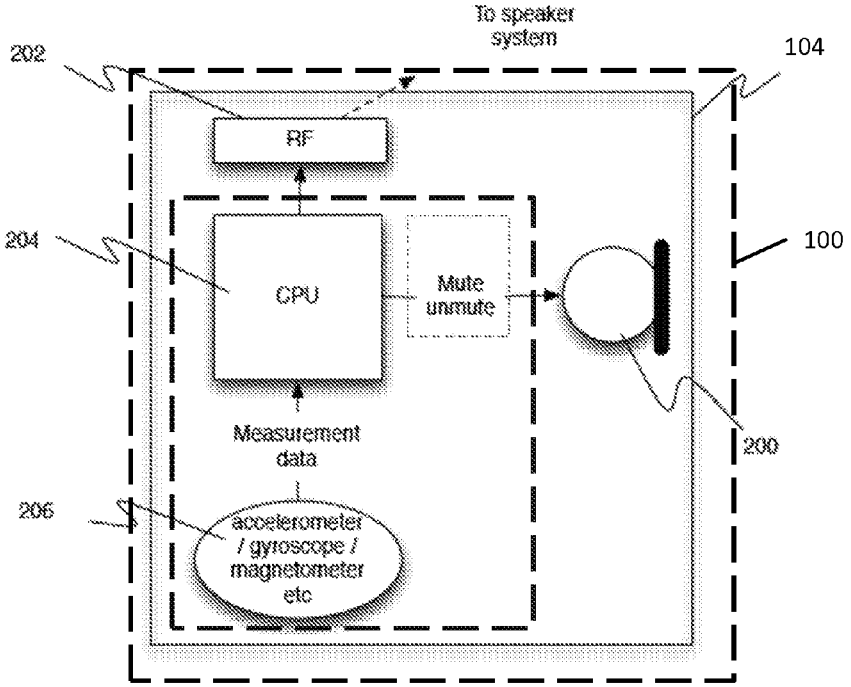

FIG. 1 illustrates embodiments of the invention. The sound path way to the microphone device is indicated by 102, an exemplified shadowed ellipse on top of the cubically embodied soft cell 100 of the microphone device. According to an embodiment the soft cell can be a module, in which the electronics are placed as another module, or alternatively the cell can be a closed module as such with integrated electronics, or in a variant, electronics can be diversified in to the module structure inside the soft cell. According to an embodiment other soft forms can be used also alternatively. Soft in this context means that it has a textural structure and lined so that when the microphone device hits a human operator it does not cause a significant injury. The microphone device is drawn inside the lining 103 indicative of the microphone system, into which the microphone device can belong as an operative system element. An external receiver is indicated by the reference number 101, and the wireless communication illustrated by the lightning shaped line, between these two system elements. The system element 101 can comprise connection further to other system parts, or to a remote system for the speakers or other audiovisual means, but also to a data base in an embodiment. In an embodiment the system element 101 can comprise also a transmitter, so it can communicate data, commands, voice related settings, speaker ID from the database, and/or parameters or updates to another microphone device. According to an embodiment variant, the muting, replacement sound adding, unmuting, sound fading, or other in microphone device performed actions can be performed in the control of the system element 101. According to an embodiment variant this can be made in the system element 101. So the sound processing can be made in the receiver site in these embodiment variants.

FIG. 1 illustrates also electronics in the casing 100, especially in the case 104, deep in the soft shell 100, which facilitates that the microphone device can be thrown without damage to the device or the person catching the microphone device, formatted system element. The electronics comprise an RF transceiver, comprising at least a transmitter, so as arranged to communicate with a system element 101. The communication can be digital formatted to follow a radio protocol as such. However, in an alternative embodiment the communication may follow analog format for an analog receiver in the system element 101, which can be a microphone system element 101 connected to the external system.

The microprocessor CPU 204 is indicated to be included into a controller unit, which is demonstrated by the dashed outer box. The controller unit is arranged to control the operations and/or parameters as well as measurement data made by the microphone device. The controller unit is drawn to comprise also a movement sensor 206 to sense the motions state of the microphone device. The implementation of the sensor can be made by using accelerometers, gyroscopes, magnetometers, barometric pressure sensor, pressure sensor or other means to sense the state of the motion. In an embodiment this can be based on acoustic signal available or sent from the microphone device, with help of Doppler effect. Between the CPU and microphone unit 200 there is a box mute/unmute indicated, which is arranged to be operable by the control signal according to which the microphone units state is changed from one state to another state, corresponding the a first state of motion and a second state of motion of the microphone device. According to an optional embodiment, although only showing the muting of microphone, a skilled person in the art knows well from the embodiments that also the communication unit can be muted during the throw or a catch, optionally or in addition to the microphone unit.

Figure 2:
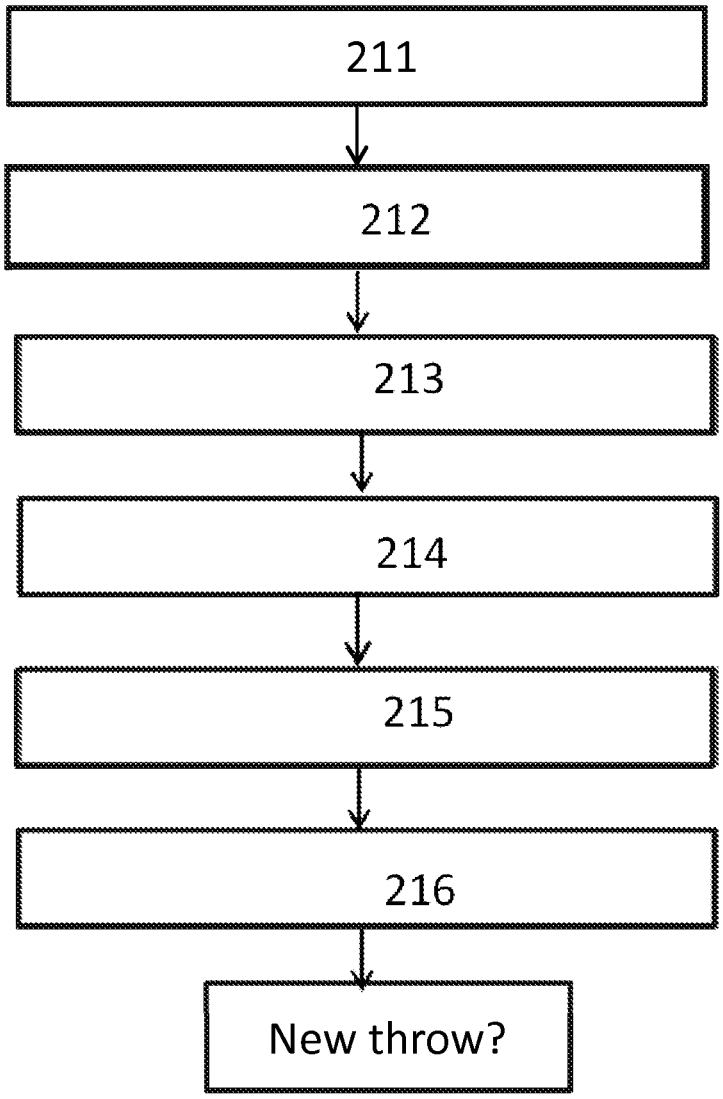
FIG. 2 illustrates a method according to an embodiment.

FIG. 2 illustrates an embodiment of the invention directed to the method of operating a microphone device.

Figure 3:
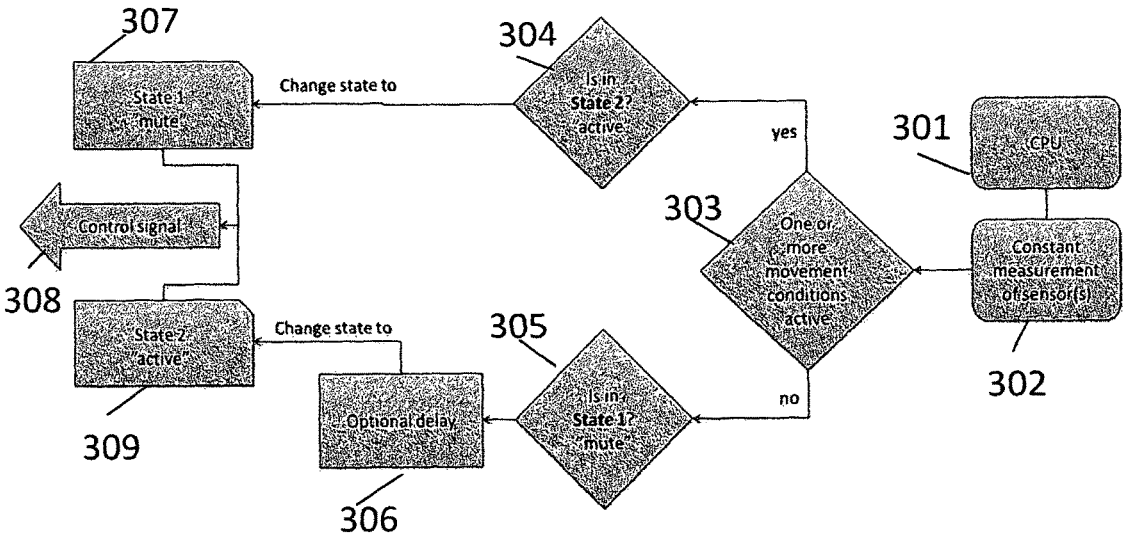
FIG. 3 illustrates a schematic view to a software used in the control signal forming.

The embodied method for operating a microphone device according to an embodiment of the invention comprises:

monitoring 211 the state of the motion of the microphone device for recognizing the state of the motion, recognizing 212 the changed state of the motion of the microphone device, as a response to the recognized changed state of the motion, generating 213 to a corresponding state of the motion a state of a control signal by the sensor unit 206, FIG. 3 Illustrates control signal formation related software operation, in a simple embodiment of the invention.

setting 214 at least one of the microphone unit 200 or the communicator unit 202 from a first state of communication corresponding a first state of the control signal to a second state of communication corresponding a second state of control signal, restoring 215 at least one of the microphone unit 200 or the communicator unit 202 from a first state of communication corresponding a first state of the control signal to a second state of communication corresponding a second state of control signal as a response to a further change in the state of the motion of the microphone device, forming 216 from the microphone signal a digital electric signal to be sent to an external station.

In an embodiment, a response may lack due to a change in motion, depending on whether the motion is seen as a throw or catch state, as it could be that a person is simply moving it in their hands. Thus, the sensors of the microphone device are arranged to give signals to the microprocessor to indicate the movement by throwing so as to set the microphone device into mute state either by muting the microphone unit or the transmitter or transceiver unit or a part thereof.

FIG. 3 illustrates control signal formation related software operation in a simple embodiment of the invention. The software algorithm in the control unit can be used according to the example in FIG. 3. The software monitors (in the method phase 212) constantly the state of the motion of the microphone device. In FIG. 3 only such states (state 1 and state 2) as "mute" and "on" ("active") are indicated as examples, without any intention to limit the dynamics of the sensors of the sensor unit in embodiments. When the sensor triggers motion or acceleration to correspond free-fall, rotation or hard acceleration or deceleration, in an event of throwing or catching, the controller unit generates a control signal that switch off the microphone unit and/or the transmitter. According to an optional embodiment the state of the microphone unit is communicated to the external microphone system element, that listens to the transmission of the microphone device, but the microphone system element external to the microphone device couples to a state in which the transmission is not passed to the sound system.

FIG. 3 indicates an example on the monitoring of the state of motion via the sensors of the microphone device and the control signal formation accordingly. According to the example, the control signal (308) is used to mute 307 and/or un-mute 309 the microphone and/or the transmitter according to the state of motion of the microphone device, via the control signal state corresponding to the state of the motion. In the example of FIG. 3, the states state 1 and state 2 are not bound to a particular state, not in other examples either, as a skilled person knows from the examples of the embodiments.

CPU 301 is used in the controlling in the example to form also the control signal 308 with the appropriate signal level corresponding the state of the motion. The microphone device's control unit monitors constantly 302 the sensors, and when at least one sensor indicates movement, the state of the motion is detected and it is checked 303 that is the motion such that the control signal state is in the state "active" 304 indicating the capability to receive and/or pass sound via the external unit of the microphone system to the sound system. In case of movement detected, the control signal state is set to correspond the state "mute" 307 indicating the incapability not to receive and/or pass sound via the external unit of the microphone system to the sound system. In case of no movement detected, although state mute 305 was present, the control signal state is set to correspond the state "active" 309 indicating the capability to receive and/or pass sound via the external unit of the microphone system to the sound system. According to an embodiment the microphone device is delayed 306 to switch on to the active state, so the handling noises after a catch can be thus eliminated with a suitable timing interval, in an embodiment less than second.

Dependently on the indication of the control unit, the state of the motion of the microphone device is changed to state 1 307 "mute" in the FIG. 3 set from an active state (304), when a throw for example is detected.

Dependently on the indication of the control unit, the state of the motion of the microphone device is changed to state 2 309 "active" in the FIG. 3 set from a mute state (305), when a catch for example is detected, and handling sound of the user in an embodiment is switched off by the delayed (306) state switch after the catch. According to the state of mute state 1 (307) or state active state 2 (309), a control signal 308 is generated so that the electronics of the microphone device can detect the state accordingly and switch the microphone and/or transmitter to the corresponding state in the control of the control signal. This way, for example states of rolling, free fall, state still, state high acceleration, state low acceleration can be detected, just to mention a few examples, not only limiting the states only to indicated examples.

A skilled person in the art knows well from the embodiments that every signal level change may be not a result from the microphone device's movement by a throw, as changing the motion and hence triggering the motion sensors does not imply a change of the state indicative for throwing the microphone device, thus it is beneficial, only when this change is seen to be great or refers to throwing or catching. For example, a person waving the microphone in his hands will not turn it off, or when the person changes the way of moving, the movement type as being standing or sitting or moving there between states of sitting, standing and walking. According to an embodiment the software of the microphone device is configured to recognize the movements according to the control signal.

According to an embodiment variant of the invention, the microphone device is remotely controlled by the microphone system element 101 so that at least the microphone is muted during a throw, but also the transmitter, in addition to or optionally. However, the microphone device in such embodiment is configured to listen the commands from the remote system element 101 external to the microphone device.

According to an embodiment of the invention, the microphone device is arranged to discriminate motion type, one first state of motion from a second state of motion or a third state of motion, etc. According to an embodiment of the invention a mentioned state of motion, (first, second, third, etc.) can be a state of motion of the microphone device when the user is handling the microphone device, walking, sitting, getting up, rotating, etc., catch and/or state of being rest, falling with a constant acceleration or speed or moving with a constant horizontal speed. For example, according to an embodiment of the invention the state of the rest is considered as a second state of motion, especially in such an embodiment, wherein it is sufficient to discriminate the throw-resulted movement from being rest or other types of movements, so actually being without a need to recognize intermediate states of motion, just throw when it happens and the catch when such happens to be the first and second state of motions of the microphone device. However, according to an embodiment of the invention the sensor unit dynamics and quantization can limit the number of states a single sensor can indicate for the microphone device. By using several sensors, especially of different types, the number of states can be increased to indicate for example intermediate states when needed, but also to clarify just a few states of motion, including throwing, catching, falling, or the user movement originating from other motions, so discriminating between high and low valued accelerations, relating respectively to the catch or starting a walk. According to an embodiment the software has a feature to set the motion discrimination parameters accordingly, in which states of motion the muting/unmuting should be performed.

According to a variant of embodiment of the invention the software has a feature, according to which a replacement sound is played during a throw and/or catch indicative of the state of the motion. According to an embodiment the sound signal can be adjusted according to the motion state to the audience. The sound level can be lowered for example, i.e. attenuated to a certain pre-determined level during the throw or part of it. This can be made also to the replacement sound if used in the embodiment. According to an embodiment of the invention, the program within the CPU is configured to work by understanding the state of the microphone device and determining whether it is being thrown or caught, distinguishing movement from simple hand gestures and variations to the device caused by normal use when a speaker is talking into the microphone.

To determine the unique state, an embodiment of the invention uses in an ensemble of sensors comprising at least one sensor or a combination of sensors that determine among other things rotation, free fall, and/or sudden acceleration or deceleration. Sudden acceleration or deceleration is understood by the CPU as an impact of the device to the ground or when it is caught or can mean the object is being thrown. In such cases, the response is to mute/lower the signal of the microphone unit. Alternatively in an embodiment variant, free fall is also detected as a movement type by using sensors, which in turn signals that the microphone is not being held in hand and hence is in an airborne state, in the air, or being thrown, again creating a response to the CPU and hence the microphone unit. In an embodiment rotation is also measured, with pivoting angular velocity, and/or multiple rotations of the microphone in a given time frame indicative of the microphone not being in use by the user and hence should be turned off in the very embodiment. It is important to monitor a number of states simply because some sensors will not offer accurate values in all orientations of the device. For example, when the device is thrown and is simultaneously rotating, the ability of the sensor to detect free fall is compromised, however, rotation can still be measured. When a mute response is triggered, a timer is set that will turn the microphone back "on" after a given timeframe, when the motion has essentially stopped (because of catch for example), usually measured in milliseconds in an embodiment, but keeps the microphone device mute during the time frame, although the state of the motion corresponds the voice active state according to the program running in the memory of the processor.

When the mute state is activated, the microphone device is in mute state, but remains in mute state until the time frame is passed, although the device was ready to receive sound. When one of the mute triggers from the sensors of the sensor unit is active, the device is put into the mute state. When the triggers become inactive, the device is put to an active state after a small delay of less than 1000 ms.

According to an embodiment the microphone device can be kept in a default state of motion, and when a change in the change of the motion detected, the state of the motion is changed from the default stage.

Examples on Use

According to an embodiment of the invention, the microphone device in question is a throwable microphone device, (microphone unit or microphone in the flowing, too, according to the context) comprising to be used as engaged to audiences and to facilitate question and answer sessions.

Contrary to normal microphones which cannot be dropped or thrown without incurring a loud noise due to forces hitting the microphone element and its casing, embodiments of the invention avoid this kind of effects by turning the microphone of the microphone unit on mute when it senses that it is being thrown and caught, thus avoiding loud noises which would cause inconvenience to the audience members as well as potentially damage the sound system which the microphone unit is connected to, according to an embodiment via the microphone system.

Such embodiments comprise several advantages, to mention a few in a non-restrictive manner. Firstly, it makes asking questions and engaging with audiences quicker since passing the microphone becomes much more efficient, especially in crowded gatherings. Embodiments of the invention also engage the audience members by making the process more interactive, with the speaker and audience members gaining a connection through the process of throwing and catching. Lastly, the embodiments of the invention have the potential to save up costs incurred from having to have as many multiple traditional microphones to accommodate large audiences as well as potentially a corresponding amount of microphone "runners", or people assigned to hold the microphones until someone poses a question. The Embodiments of the invention can also be used in smaller groups and different settings, for example in team brainstorming sessions, where the microphone is passed between team members who each express their opinion on a matter or within educational settings such as a classroom or a lecture hall.

According to an embodiment, the microphone device can perform in the microprocessor sound checks, spectral measurements of the sound in suitable part, and communicate the results to the external unit in the same system.

According to an embodiment of the invention the active state is about to be switched on after a delay when the motion is deduced to be stopped so that the speaking can start. According to an embodiment the delay is less than 800 ms, preferably less than 500 ms. So the handling of the microphone device can be made quietly at the beginning.

Examples on Further Embodiments

Embodiments of the invention are in a microphone setup configured to be automatically put on mute when the microphone is tossed to the audience. In a very simple form of embodiments, there is at least one sensor (e.g. accelerometer) to be used in the formation of the control signal to mute/unmute the microphone device's microphone and/or the radio transmitter, according to the state of the motion of the microphone device. However, improvement is achieved when a redundant sensor is used, so that false detections can be minimized. Suitable sensors are for example accelerometers and gyroscopes, from which latter types can be used detecting rotation movements, that are typical to a toss of the microphone device.

The device has inbuilt sensors implemented by at least one ensemble of sensor units comprising at least one sensor, such as an accelerometer, gyroscope or magnetometer and the like that sense zero gravity state, orientation, acceleration and throw speed when the microphone is in motion. Doppler phenomena can be used in the measurements, especially in the measurement state, in which the microphone device can make observations from the space in which it is used, the sound and echo as well as other data to be used to fine tune the operation of the microphone unit.

Thus, the microphone can be automatically put on mute using a controller unit that comprising processing unit CPU. As the sensors, sense the stability of the microphone, they send the information to CPU, which forms the control signal and toggles microphone state to non-mute (active) state. As the microphone is active, it can send audio via radio interface (RF) to external speaker system or a receiver.

According to an embodiment the mute state corresponds to the first state of motion, the first state of communication, and the active state corresponds to the second state of motion, the second state of communication. A skilled man in the art knows from the expressions mute state and active state, that in corresponding embodiments in which the microphone unit and/or communicator units are in mute state or in active state, they can pass the respective signal from the unit forward according to the indication of the control signal state corresponding the first state and second state.

According to an embodiment the control signal can be an analog signal, according to which embodiment passing a state corresponding pre-set threshold is detected in the controller unit. According to an embodiment the control signal can be a digital signal, according to which embodiment a matching pulse train corresponding pre-set state of control signal is detected in the controller unit, and latched for the operation of the further components of the microphone device. In a respective embodiment, the threshold ranges or the threshold criteria indicative of the state of the motion can be formed according to the control signal type.

According to an embodiment of the invention, the communication unit can comprise an analog radio transmitter, but alternatively the transmitter can be digital. The type of the transmitter can be selected, according to the external system's receiver to be used for the sound system. According to an embodiment, the transmitter can be only one type for certain type of sound systems, but according to an embodiment of the invention the communicator unit can comprise both facilities to be chosen according to the external sound system's receiver. According to an embodiment the external system can send to the embodied microphone system information which type, analog or digital transmission should be used with the sound system. Such automatic recognition may also comprise other parameter exchange between the external system's devices and a microphone device using the system.

According to an embodiment of the invention the communicator's transmitter part can be a replaceable module. According to an embodiment of the invention the module is a quick switchable analogue or a digital transmitter. According to an embodiment the module can in a variant comprise also a receiver to receive RF-signals. According to an embodiment the communicator unit 202 can be embodied by a body-pack transmitter or transceiver as such that is commonly available in the markets.

When the microphone of the microphone device is not in use as microphone, for example during throw or toss, according to an embodiment, the microphone is muted but according to another embodiment the transmitter is muted. According to a further optional variant of the embodiments, both are muted. In such an embodiment variant, the receiver present in such an embodiment of the microphone device should be left functional to listen to the commands to be passed to the CPU to control the parts that are to be muted and/or activated according to the state of the motion, by the commands from the microphone system element.

Even Further Examples

In an embodiment of the invention the muting can occur within the actual device or within the receiver whereby the device also sends a separate signal to the receiver which identifies its current state and hence whether it should be muted In an embodiment of the invention, the device can also choose to fade the sound coming from the microphone instead of muting it, so that the second state or first state in question is that state In some embodiment variants, the device can also choose the microphone system embodied to replace the sound from the microphone, muting the microphone and then adding a sound over it (example: when the microphone is thrown it makes a high pitched noise) so that the second state or first state in question is that state.

In an embodiment variant, the microphone device can be integrated within a soft shell to avoid impact damage to the electronics as well as injury to potential users In an embodiment variant Lights and other indicators can be attached to the device to indicate its state. As for an Example: the microphone device or part of it glows green when it is being thrown.

According to an embodiment, the microphone device can be a stand-alone system that attaches to body pack transmitters instead of using inbuilt transmitter system or radio interface.

According to an embodiment of the invention the microphone device comprises a nano-transmitter tuned to a broad cast channel in the range of 88 MHz to 108 MHz, so facilitating use in robust conditions. The nano transmitter can be a known as such transmitter, to be operable in very short distances where the local laws allow use of common broadcast channels in that way.

According to an embodiment of the invention the catch is recognized by the sensor unit, and the microphone and/or the transmitter of the microphone device are/is muted accordingly.

According to an embodiment of the invention, the soft cell can be implemented, in suitable part if not entirely, by a gaseous inflatable structure, like balloon inside of which there is the electronics module mounted. In such an embodiment the catch for example can be detected by using a pressure sensor in the structure so to mute/unmute the microphone and/or the transmitter according to the control signal formed by the control unit with the help of the pressure sensor. A surprising effect can be gained by using a barometric pressure sensor that is capable of detecting pressure differences typical to altitude changes, so as to measure the altitude of the microphone device also during the throw.

The invention claimed is:

1. A throwable microphone device, comprising:

a casing (100);

a microphone (200);

a communicator (202);

a controller (201), comprising a memory and a microprocessor (204); and a sensor (206), wherein the casing includes a soft shell that protects the microphone and the communicator from being damaged when thrown, and wherein the sensor comprises a gyroscope that senses a state of a motion of the microphone device in rotation, and that provides a control signal responsive to the state of the motion of the microphone device rotating, so that in response to the control signal of said sensor (206), at least one of the microphone (200) and the communicator (202) is/are set from a first state of communication corresponding to a first state of the control signal to a second state of communication corresponding a second state of the control signal, and wherein the control signal has a quantity value in a pre-determined range that represents the state of the motion as a value that defines the state of the motion according to whether the control signal value belongs to the range of the first control signal level that corresponds to the first state of motion or to the range of the second control signal level that corresponds to the second state of motion.

2. The microphone device of claim 1, wherein said first state of communication is a state of silence (307), voice non-active.

3. The microphone device of claim 1, wherein said second state of communication is a state of un-mute (309), voice active.

4. The microphone device of claim 1, wherein the communicator (202) comprises a transmitter-receiver for a duplex communication with an external device.

5. The microphone device of claim 1, wherein the controller comprises a coder programmed to code a microphone signal from the microphone into a digital form electric signal.

6. The microphone device of claim 1, wherein the sensor (206) comprises the gyroscope and at least one of the following components: accelerometer, magnetometer, position sensor, acoustic sensor for Doppler measurements, a barometric pressure sensor, other pressure sensor, such a combination of said components that is comprising at least one kind of said components equally or more than two.

7. The microphone device of claim 1, wherein the communicator (202) comprises any of a transmitter, a receiver, and a transceiver, being mountable to the microphone device as an additional module.

8. A method for operating a microphone device according to claim 1, comprising:

monitoring (211), (302) the state of the motion of the microphone device for recognizing the state of the motion;

recognizing (212) (303) the changed state of the motion of the microphone device;

responsive to the recognized changed state of the motion, generating (213), to a corresponding state of the motion, a control signal (308) having a state of a control signal, by the sensor (206);

setting at (214) least one of the microphone (200) and the communicator (202) from a first state of communication corresponding to a first state of the control signal to a second state of communication corresponding a second state of control signal;

restoring (215) at least one of the microphone (200) or the communicator (202) from the second state of communication corresponding the second state of the control signal to the first state of communication, corresponding to a state of the control signal as a response to a further change in the state of the motion of the microphone device; and forming from the microphone signal an electric signal to be sent to an external system element of the microphone system.

9. The method of claim 8, wherein the microphone device is set into a third state, corresponding to a measurement state, in which the microphone device is programmed to make measurements from a signal from at least one microphone of the microphone device.

10. A microphone system (103), comprising:

a communication device (101) that is external to at least one microphone device according to claim 1, said external communication device being arranged to communicate with said at least one microphone device.

11. The microphone device of claim 2, wherein said second state of communication is a state of un-mute (309) and voice active.

12. The microphone device of claim 2, wherein the communicator (202) comprises a transmitter-receiver for a duplex communication with an external device.

13. The microphone device of claim 3, wherein the communicator (202) comprises a transmitter-receiver for a duplex communication with an external device.

14. The microphone device of claim 1, wherein the sensor also comprises at least one of an accelerometer and a magnetometer.

* * * * *